US007040904B2

(12) United States Patent
Kajimoto

(10) Patent No.: US 7,040,904 B2
(45) Date of Patent: May 9, 2006

(54) CONNECTOR

(75) Inventor: Junya Kajimoto, Kanagawa (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 0 days.

(21) Appl. No.: 10/963,581

(22) Filed: Oct. 14, 2004

(65) Prior Publication Data

US 2005/0148215 A1 Jul. 7, 2005

(30) Foreign Application Priority Data

Oct. 15, 2003 (JP) ..... 2003-355704

(51) Int. Cl.
*H01R 12/00* (2006.01)

(52) U.S. Cl. ..... 439/74; 439/247

(58) Field of Classification Search ..... 439/74, 439/247, 248

See application file for complete search history.

(56) References Cited

U.S. PATENT DOCUMENTS

| | | | | |
|---|---|---|---|---|
| 5,445,529 | A | 8/1995 | Yamamoto | |
| 6,435,890 | B1 * | 8/2002 | Kato et al. | 439/247 |
| 6,439,928 | B1 * | 8/2002 | Akama et al. | 439/608 |
| 6,609,922 | B1 * | 8/2003 | Torii | 439/247 |
| 6,755,691 | B1 * | 6/2004 | Sasame et al. | 439/607 |
| 6,773,283 | B1 * | 8/2004 | Yoshimatsu et al. | 439/180 |
| 6,805,586 | B1 * | 10/2004 | Akama et al. | 439/608 |
| 6,875,027 | B1 * | 4/2005 | Ye et al. | 439/74 |

FOREIGN PATENT DOCUMENTS

| | | |
|---|---|---|
| EP | 0 519 264 A2 | 12/1992 |
| EP | 1 111 728 A2 | 6/2001 |
| EP | 1 143 571 A2 | 10/2001 |
| JP | 07-135045 | 5/1995 |
| JP | 08-250176 | 9/1996 |
| JP | 08-288045 | 11/1996 |
| JP | 10-040911 | 2/1998 |
| JP | 10-050410 | 2/1998 |
| JP | 2000-188148 | 7/2000 |
| JP | 2000-200655 | 7/2000 |
| JP | 2000-209737 | 7/2000 |
| JP | 2000-260527 | 9/2000 |
| JP | 2001-143785 | 5/2001 |
| JP | 2002-025675 | 1/2002 |
| JP | 2002-093490 | 3/2002 |
| JP | 2003-187915 | 7/2003 |

OTHER PUBLICATIONS

EP Search Report, Nov. 22, 2004.

* cited by examiner

*Primary Examiner*—Gary F. Paumen
(74) *Attorney, Agent, or Firm*—Rader, Fishman & Grauer PLLC

(57) ABSTRACT

A connector of a simple structure adapted to absorb a positional deviation which occurs when a plug and a receptacle are fitted into each other, without spoiling the strength of the connector is provided. The connector has a plug, and a receptacle into which the plug is fitted. A receptacle housing holding receptacle contacts and formed out of an insulating material is provided with projecting portions extending in the direction crossing the fitting direction. A plug housing holding plug contacts is provided with wall portions having recesses which extend in the fitting direction, and which are capable of having the projecting portions provided on the receptacle housing engaged therewith. The width of the projecting portions is smaller than that of the recesses, and the receptacle engaged with the plug housing swings in the direction crossing the fitting direction to absorb a deviation of the position of the connector.

2 Claims, 11 Drawing Sheets backward
right
left
forward
1
110
100
101
12
11
112
111
X
20
201
202
203
Y
123
122
121
10a
10b up
right
left
down
10b
10a
110
20
100
101 backward
up
forward
down
10b
10a
101
201

CONNECTOR

CROSS-REFERENCE TO RELATED APPLICATIONS

This application is based upon and claims the benefit of priority from Japanese Patent application No. 2003-355704 filed on Oct. 15, 2003, the entire contents of which is incorporated herein by reference.

FIELD OF THE INVENTION

The present invention relates to a connector used to electrically connect a pair of boards on which electric circuits are implemented.

RELATED ART

As a connector mounted on boards and used to electrically connect the boards, a connector provided with a mechanism for absorbing a positional deviation which occurs when the connector is joined with the other connector has heretofore been known. As an example of such a known connector, a connector which is mounted on boards and has a leg portion exposed to the outside, by which the leg portion absorbs a deviation of the connector which occurs when the connector is joined with the other connector is disclosed (refer to JP-A-2000-260527). According to this connector, the leg portion of the contact is made of a member having elasticity such as a metal wire, and the leg portion is not covered with a housing but exposed to view, so that the leg portion is deformable and can absorb the deviation of joining.

Since the positional deviation is absorbed in the above-described related art example, the leg portion of the contact exposed to the outside is made of an extremely thin, linear metal piece. The leg portion is formed so that the leg portion is fixed to a board, and supports the housing which is made of an insulating material, in a floated state. Therefore, a load imparted to the leg portion is large, and the leg portion becomes liable to be broken. Moreover, in this connector, spacers are fixed to the boards on which the connector having the leg portion exposed to the outside is fixed, and the degree of deformation of the leg portion is thereby restricted. However, the spacers are formed as members separated from the connector body. This causes not only the number of parts to increase but also a large space for fixing the connector to be needed, so that a demand for a high-density mounting cannot be met.

SUMMARY OF THE INVENTION

In view of these problems, the present invention aims at providing a connector capable of absorbing a positional deviation occurring when the connector is joined with the other connector, without spoiling the strength of the connector. Another object of the present invention is to provide a connector capable of absorbing the positional deviation by a simple structure without increasing the number of parts of the connector.

The present invention provides the following so as to solve the above-mentioned problems. (1) A connector including a plug having a plurality of plug contacts and a plug housing for holding the plug contacts, and a receptacle having a plurality of receptacle contacts and a receptacle housing for holding the receptacle contacts; the plug contacts and the receptacle contacts being connected by fitting the receptacle into the plug; wherein the receptacle housing is provided with a projecting portion extending in the direction crossing the fitting direction between the receptacle and the plug; and wherein the plug housing is provided with a wall portion extending in the fitting direction and having a recess with which the projecting portion of the receptacle housing can be engaged; and the width of the projecting portion being smaller than the width of the recess of the wall portion of the plug housing.

(2) The connector according to (1); wherein the recess extends to a front edge of the wall portion, and the depth of the recess increasing toward the front edge of the wall portion.

(3) The connector according to (1) or (2); wherein the plug housing is provided with a first plug housing member, and a second plug housing member disposed away from the first plug housing member; the second plug housing member being provided with the wall portion; and the plug contacts being made of elastic members, and combining the second plug housing member with first plug housing member.

(4) The connector according to (3), wherein the plug contacts are provided with plate type contact portions connected with the receptacle contacts and made of elastic members; and wherein the receptacle contacts is provided with bifurcated holding portion holding the contact portions and made of elastic members.

(5) A connector including a plug having a plurality of plug contacts and a plug housing for holding these plug contacts, and a receptacle having a plurality of receptacle contacts and a receptacle housing for holding the receptacle contacts; the plug contacts and the receptacle contacts being connected by fitting the receptacle into the plug; wherein the plug housing is provided with a first plug housing member and a second plug housing member disposed away from the first plug housing member; and the plug contacts being made of elastic members and combining the second plug housing member with the first plug housing member.

According to (1), the part of the plug into which the projecting portion of the receptacle housing is inserted along the recess of the wall portion provided in the plug housing is determined when the receptacle is inserted into the plug in the opposed direction, and the receptacle is then fitted into the plug. Therefore, the engagement of the plug and the receptacle with each other can be mechanically carried out with ease. The width of the projecting portion provided on the outer surface of the receptacle housing is smaller than that of the recess of the wall portion of the plug housing, and the projecting portion and the recess of the wall portion are engaged with each other with a clearance having a predetermined width therebetween. Accordingly, the receptacle swings in a space corresponding to the width of the clearance to absorb the deviation occurring between the plug and the receptacle. Since the recess and the projecting portion are provided in and on the plug housing and the receptacle housing respectively, the lowering of the strength of the connector can be prevented. Moreover, the high-density mounting of the connector can be attained while preventing an increase in the number of parts.

According to (2), the recess provided in the plug housing extends to the front edge of the wall portion, and is tapered so that the depth of the recess becomes larger toward the front edge of the wall portion. This tapering portion functions as a guide when the projecting portion of the receptacle housing is inserted into the recess of the wall portion, and the part which is restricted by a pair of the wall portions and into which the receptacle housing is inserted can be further precisely restricted.

According to (3), the second plug housing member is provided on the inner side of the first plug housing member, and the wall portion having the recess into which the projecting portion of the receptacle housing is inserted is provided on this second plug housing member, so that the engagement of the plug and the receptacle is easily carried out. Since the first plug housing member and the second plug housing member are combined together with a space left therebetween so that these housing members have clearances of a predetermined width via the elastic members, the second plug housing member swings in the clearances and absorbs a deviation. This enables the positional deviation to be absorbed in the clearances between the recess and the projecting portion, and also in the clearances between the first plug housing member and the second plug housing member. Namely, this connector is capable of absorbing the positional deviation in two stages.

According to (4), the plug contacts have plate type contact portions connected with the receptacle contacts, while the receptacle contacts have bifurcated holding portions adapted to hold the plate type contact portions therebetween. Therefore, the plug and the receptacle swing so as to absorb a positional deviation. This can prevent the occurrence of a failure in connection of the plug contact and the receptacle contact with each other which causes imperfect contact of these parts. Since the contact portions and the holding portions are all made of elastic members, such as metal members, the contact portions and the holding portions can swing in the direction in which the wall portion and the projecting portion, or the first housing member and the second housing member swing, so that a positional deviation can be absorbed.

According to (5), the first housing member and the second housing member are joined together in a spaced manner via the elastic member so that the first and second housing members have a clearance of a predetermined width therebetween. Therefore, the second plug housing member swings in the clearance between itself and the first plug housing member to enable a positional deviation to be absorbed.

DESCRIPTION OF THE PREFERRED EMBODIMENT

Figure 1:
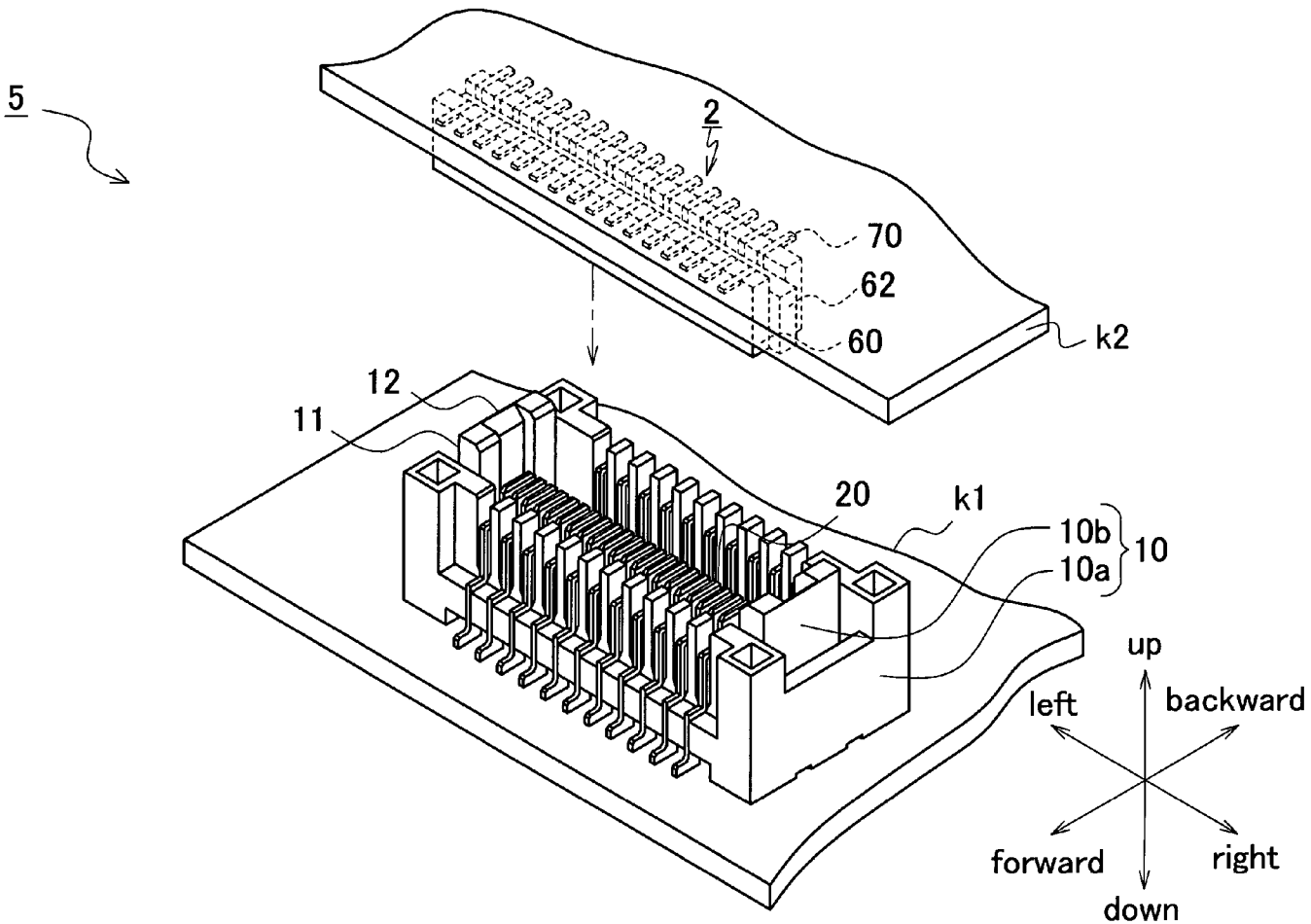
FIG. 1 is a general perspective view showing a connector according to a first embodiment of the present invention.

Embodiments of the present invention will now be described by using the drawings. The same reference numerals will be added to the same members, and the description thereof will be omitted or simplified.

FIG. 1 is a perspective view showing the condition in which a connector 5 of an embodiment of the invention is a fitted state. The connector 5 has a plug 1, and a receptacle 2 to be engaged with the plug 1. The plug 1 is provided with a plurality of plug contacts 20, and a plug housing 10 holding these plug contacts 20. The plug housing 10 is formed out of an insulating material, such as a synthetic resin, and has a shape of a substantially rectangular frame formed by a pair of longer members and a pair of shorter members.

The receptacle 2 is provided with a plurality of receptacle contacts 70, and a receptacle housing 60 holding these receptacle contacts 70. The receptacle housing 60 is formed out of an insulating material, such as a synthetic resin, and has a shape of a substantially rectangular solid of a size permitting to be fitted into the plug housing 10.

The plug 1 is fixed to a board "k"1 by soldering parts of the plug contacts 20 thereto. The receptacle 2 is fixed to a board "k"2 by soldering parts of the receptacle contacts 70 thereto. The board "k"1 to which the plug 1 is fixed and the board "k"2 to which the receptacle 2 is fixed are disposed in an opposed state. When the boards "k"2, "k"1 are moved in the opposed directions (vertical direction in FIG. 1), the receptacle 2 is fitted into the plug 1, and the receptacle contacts 70 and the plug contacts 20 are connected.

Figure 2:
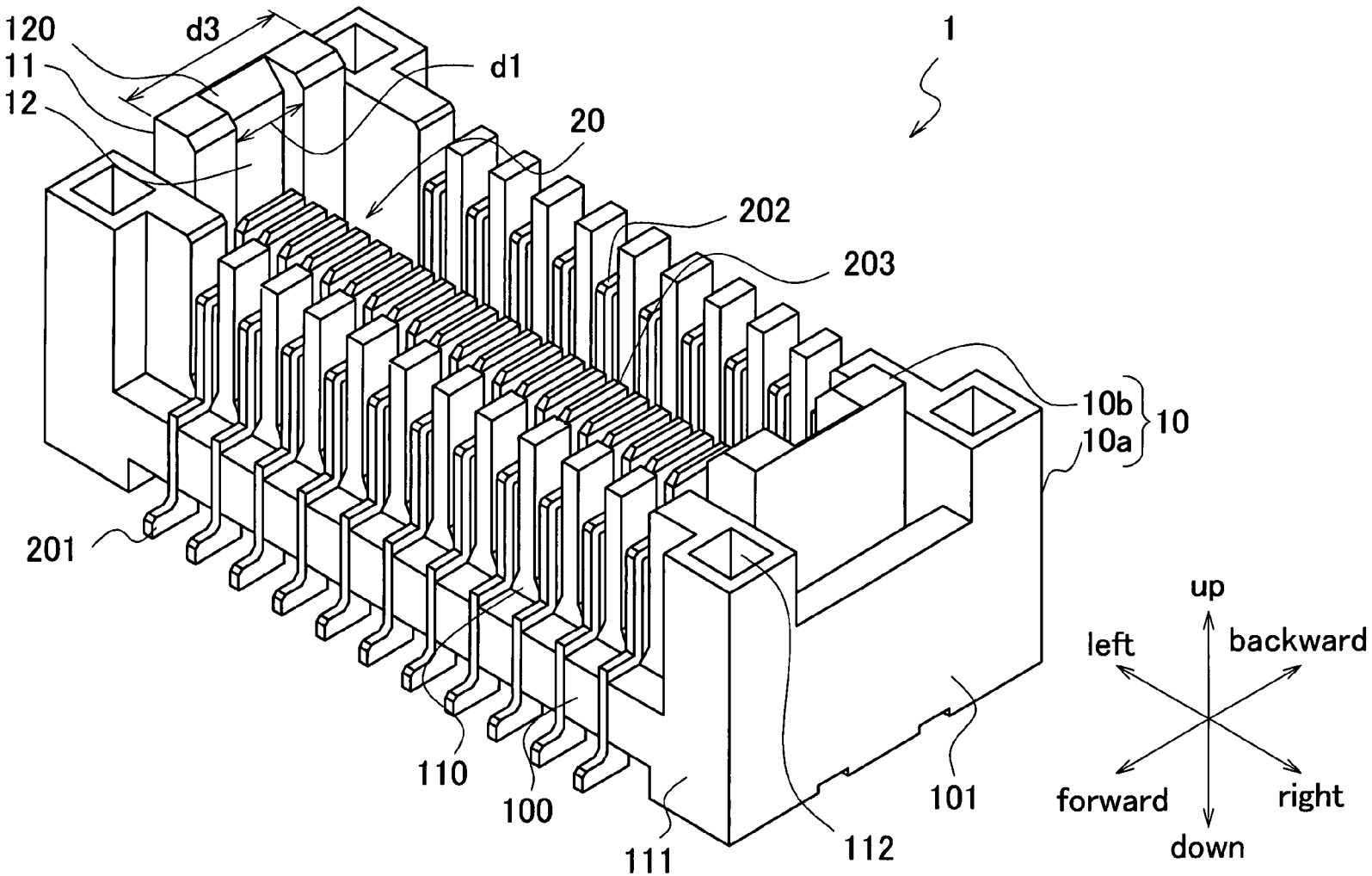
FIG. 2 is a general perspective view of a plug in this embodiment.
Figures 3A, 3B, 3C:
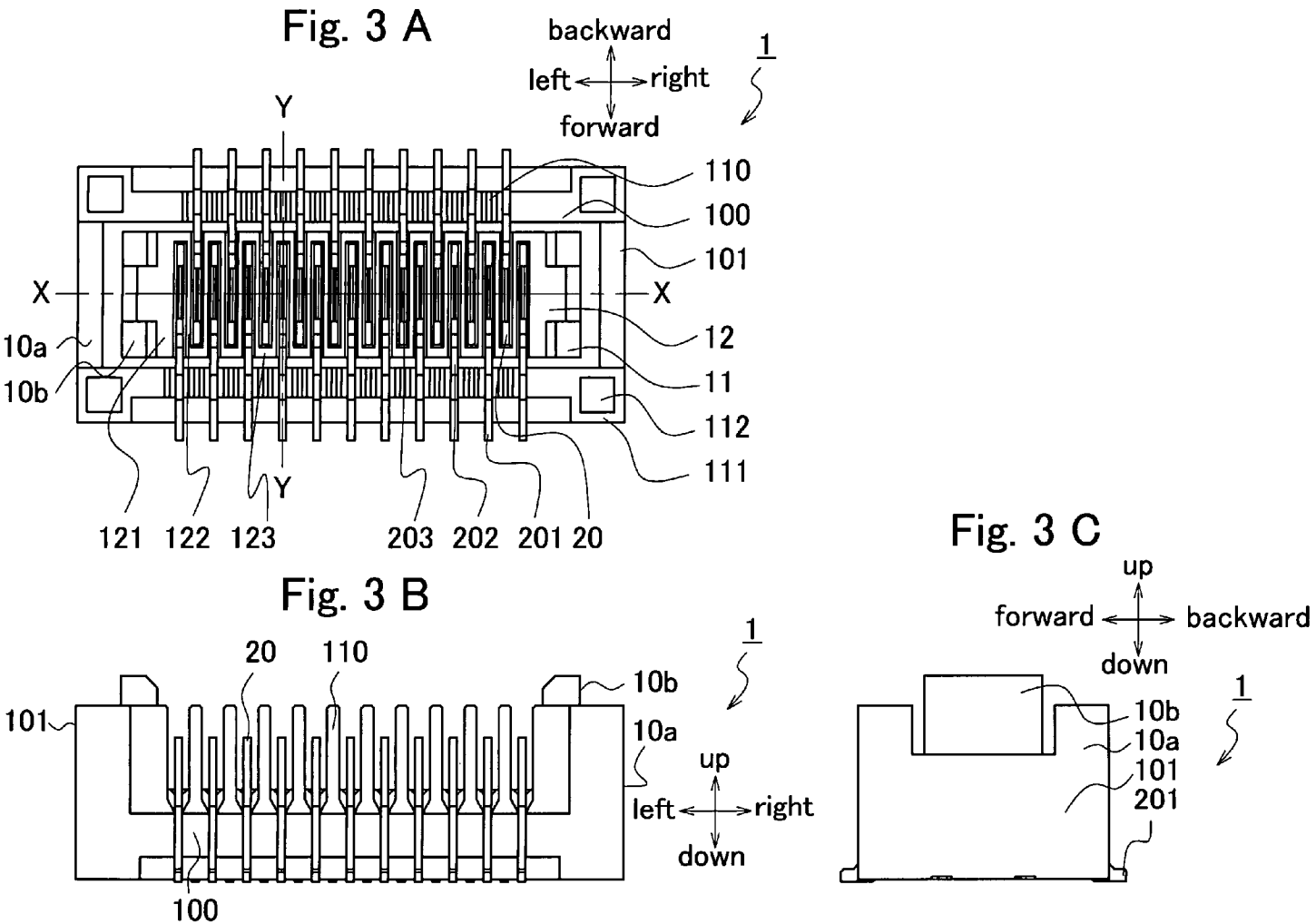
FIG. 3A is a plan view of the plug in the same embodiment.
FIG. 3B is a front view of the same plug.
FIG. 3C is a side view of the same plug.

The plug 1 will now be described in detail by using FIGS. 2 and 3. FIG. 2 is a general perspective view of the plug 1 of FIG. 1, with a fitting surface at which the plug 1 and the receptacle 2 are engaged with each other directed upward. FIG. 3A is a plan view of the plug 1 of FIG. 2, with the fitting surface directed upward, FIG. 3B is a front view of the plug 1 of FIG. 3A, and FIG. 3C is a side view of the plug 1 of FIG. 3A.

As shown in FIG. 2, the plug housing 10 of the plug 1 in this embodiment is provided with a first plug housing member 10*a*, and a second plug housing member 10*b*. The first plug housing member 10*a* has a shape of a substantially rectangular frame formed by a pair of opposed longer pieces 100 of a resin, and a pair of shorter pieces 101 of a resin disposed in an opposed state and at right angles to the longer pieces 100. The four corner portions of the plug housing 10 are formed like square columns 111 having square holes 112 therein. The longer pieces 100 are provided thereon with a plurality of protective walls 110 arranged like teeth of a comb in the longitudinal direction. Among the protective walls 110, parts of the plug contacts 20 are provided. Parts of the plug contacts 20 are also buried in the longer pieces 100.

Figure 4:
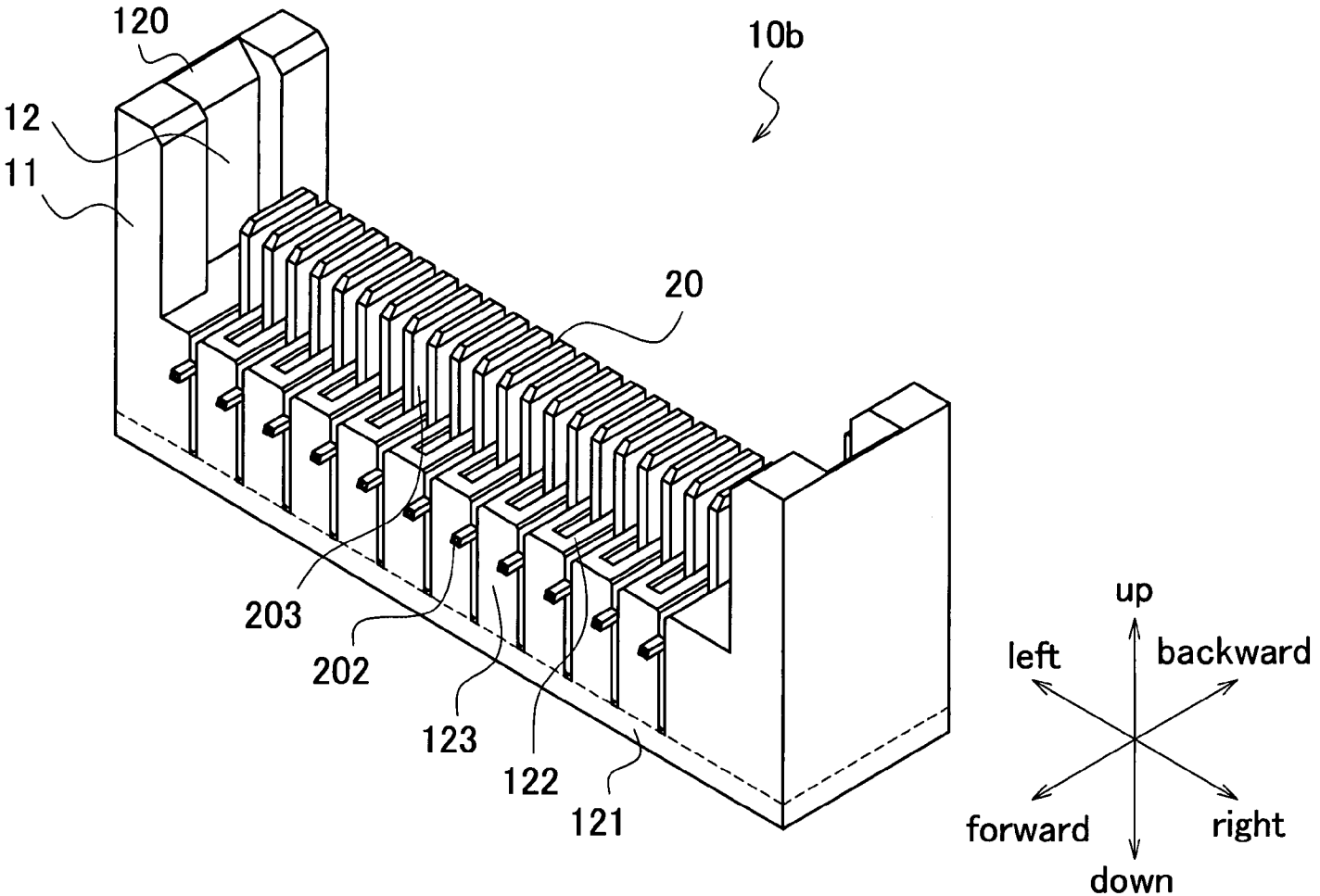
FIG. 4 is a general perspective view of a second plug housing member in the same embodiment.

In the interior of the first plug housing member 10*a* which is surrounded by the longer pieces 100 and shorter pieces 101, the second plug housing member 10*b* is provided. FIG. 4 is a general perspective view of the second plug housing 10*b* with the fitting surface directed upward. The second plug housing member 10*b* has a rectangular flat bottom plate 121 of a resin, on both of longitudinal end portions of which a pair of opposed wall portions 11 are provided. The plug contacts 20 are arranged in the longitudinal direction on the bottom plate 121. Among the plug contacts 20 arranged on the bottom plate 121, partition plates 122 are provided, and one side ends of a pair of adjacent partition plates 122 are joined together by connecting plates 123.

The wall portions 11 are provided with recesses 12 extending in the fitting direction (vertical direction of FIG. 4 in which the plug 1 and receptacle 2 are engaged with each other). The recesses 12 extend from base end of the wall portions 11 to front edge thereof in the direction in which the plug 1 and the receptacle 2 are engaged with each other. The front edge portions of the recesses 12 are cut so as to have tapering surfaces 120 having a depth becoming larger toward the front edge thereof. Owing to these recesses 12, the fitting of the receptacle 2 into the plug 1 can be done easily.

Figure 5:
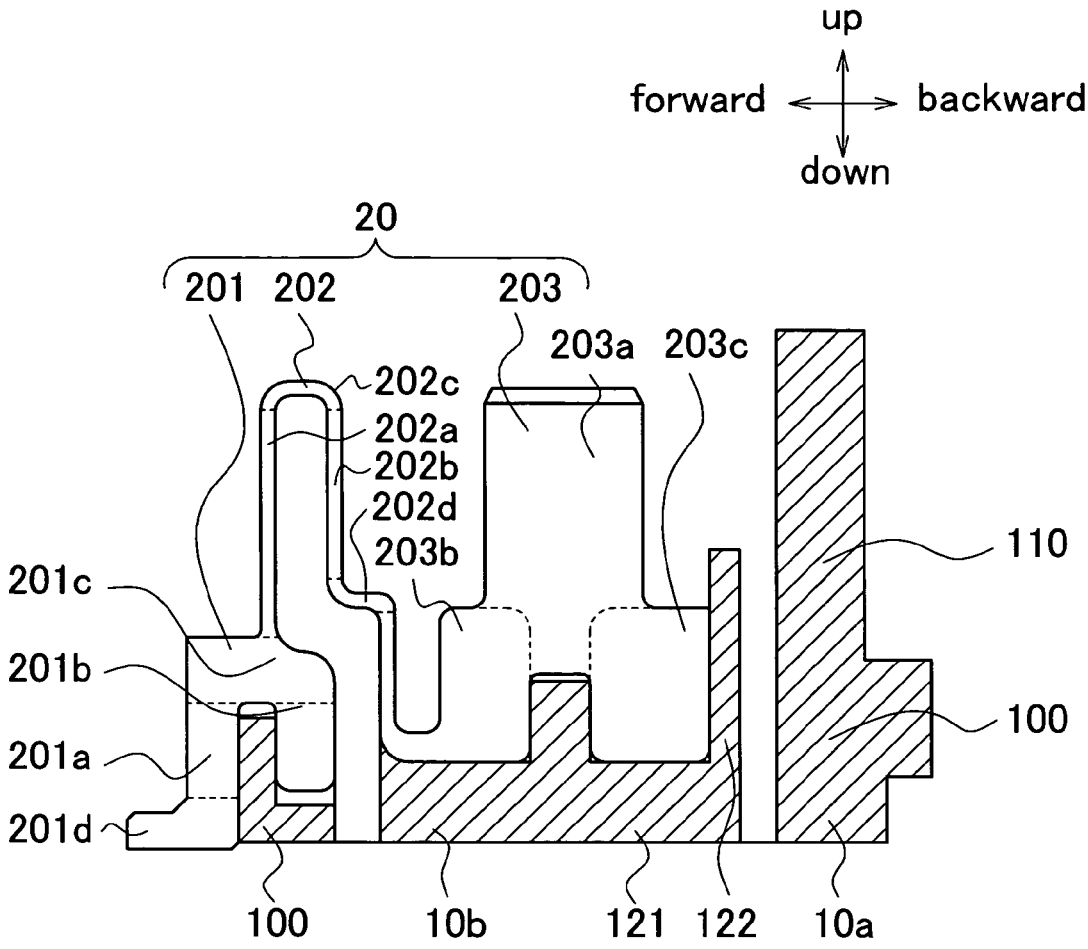
FIG. 5 is a sectioned schematic diagram of the plug in the same embodiment.

A plug contact 20 will now be described in detail by using FIG. 5. FIG. 5 is a sectioned schematic diagram of the plug 1 of FIG. 3A cut along the line Y—Y therein. The plug contact 20 is formed out of a conductive material, such as a metal, and has a plug leg portion 201, a connecting portion 202 and a contact portion 203. The plug leg portion 201 is held with a part thereof buried on the longer piece 100 of the first plug housing member 10*a*, and the contact portion 203 is held with a part thereof buried on the bottom plate 121 of the second plug housing member 10*b*.

The connecting portion 202 is joined to the contact portion 203 and the plug leg portion 201 to electrically connect the contact portion 203, connecting portion 202 and the plug leg portion 201 together. The connecting portion 202 combines the first plug housing member 1O*a* and the second plug housing member 10*b*. A pair of the plug contacts 20 adjacent to each other in the longitudinal direction of the second plug housing member 10*b* are arranged thereon so that the plug leg portions 201 and the connecting portions 202 extends in mutually opposite directions in the lateral direction of the second plug housing member 10*b* as shown in FIG. 3A (forward or rearward direction in FIG. 3A).

The contact portion 203 has a plate type section 203*a* connected with the receptacle contact 70, a plate type leg section 203*c* and an L-type leg section 203*b* joined to the connecting portion 202. Since the plate type leg section 203*c* and the L-type leg section 203*b* are buried at a part of each thereof in the bottom plate 121 of the second plug housing member 10*b*, the contact portion 203 is held by the second plug housing member 10*b*.

The plug leg portion 201 has an outer branching leg section 201*a* and an inner branching leg section 201*b* which extend in the fitting direction shown by the vertical direction in FIG. 5. The outer branching leg section 201*a* and the inner branching leg section 201*b* are joined to each other at a common base end part 201*c*, all of which are formed generally in substantially the shape of the letter "U". A plug-fixing part 201*d* is provided at a front end of the outer branching leg section 201*a*. The plug-fixing part 201*d* is soldered to the board "k"1, by which the plug 1 is fixed to the board "k"1. The base end part 201*c* constituting a substantially U-shaped bottom side part of the plug leg portion 201 is joined to the connecting portion 202.

The connecting portion 202 has an outer branching section 202*a* and an inner branching section 202*b* which extend in the fitting direction shown by the vertical direction in FIG. 5. The inner branching section 202*b* is joined to an intermediate horizontal section 202*d* bent in the direction which crosses the fitting direction and extends toward the contact portion 203, thereby the inner branching section 202*b* being joined to the connecting portion 203 via the intermediate horizontal section 202*b*. The outer branching section 202*a* is joined to the plug leg portion 201. The outer branching section 202*a* and the inner branching section 202*b* are joined to each other by the horizontal connecting section 202*c* with a predetermined width of space left between these branching sections so that all of these sections are formed into a substantially U-shaped body. Thus, a clearance occurs between the outer branching section 202*a* and the inner branching section 202*b*, and the first plug housing member 10*a* and the second plug housing member 10*b* are combined together with a space left between them.

The connecting portion 202 is formed by a thin elastic metal piece and has substantially the shape of the letter "U", so that the second plug housing member 10*b* becomes able to be swung by a width corresponding to that of the space between the inner and outer branching sections 202*b*, 202*a* in the direction crossing the fitting direction. Therefore, the space between the first plug housing member 10*a* and the second plug housing member 10*b* absorbs a positional deviation occurring between the plug 1 and the receptacle 2. The shape of the connecting portion 202 is not limited to the substantially U-shaped mentioned above. A connecting portion having an arbitrary shape capable of combining the first plug housing member 10*a* and the second plug housing member 10*b* together in a mutually spaced manner can be employed. As another shape of the connecting portion, for example, a metal wire forming ridges and valleys can be cited.

Figure 6:
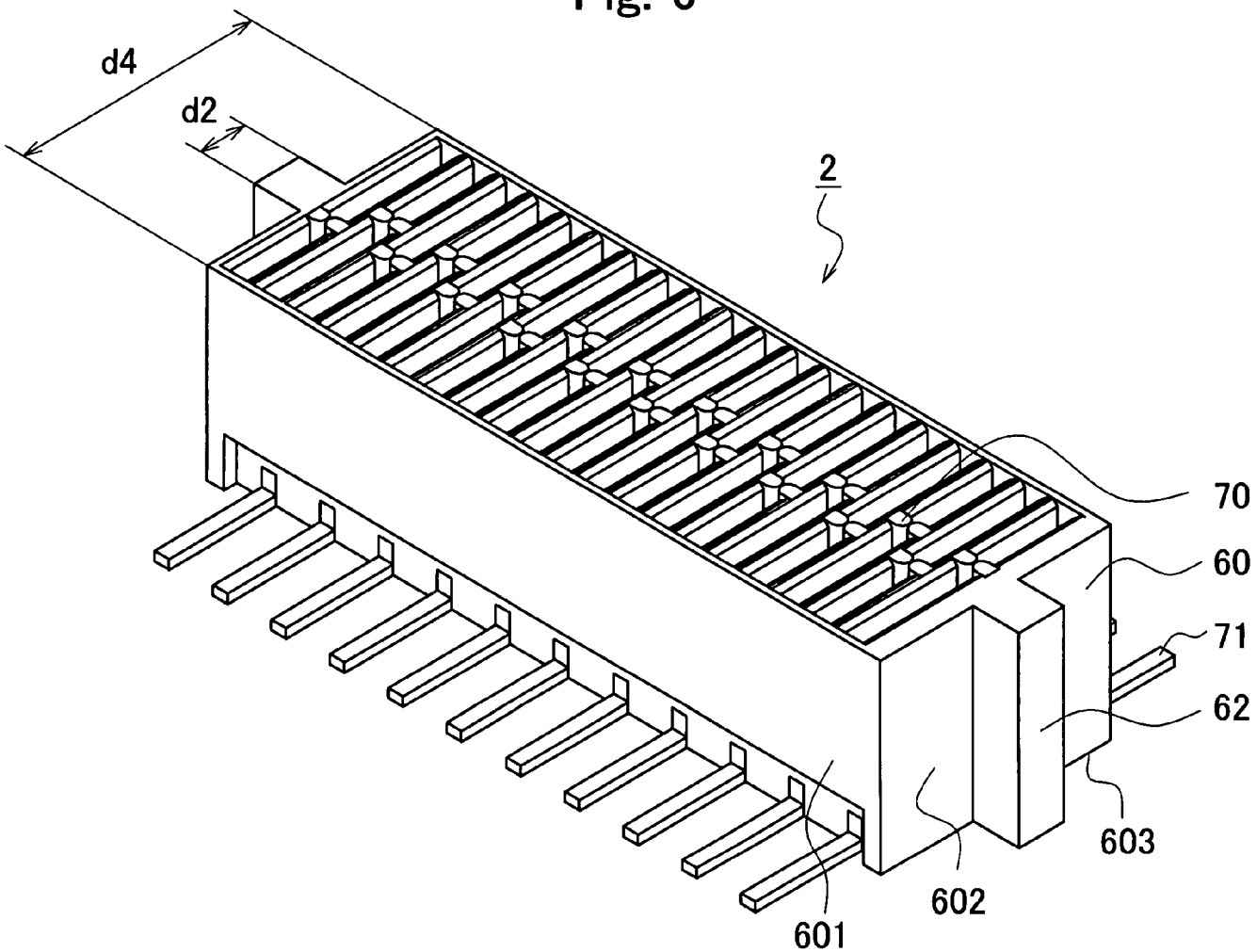
FIG. 6 is a general perspective view of a receptacle in the same embodiment.
Figure 7A:
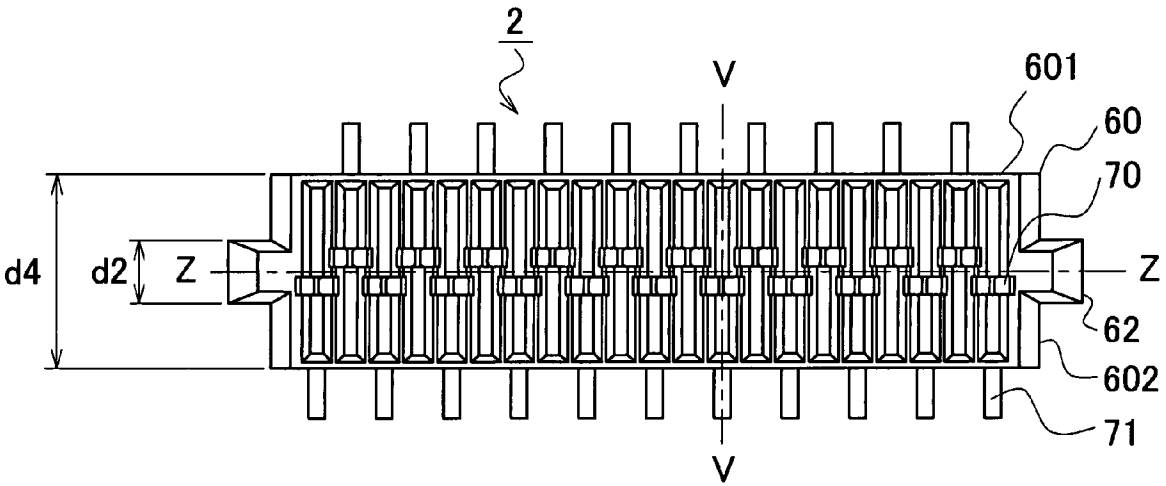
FIG. 7A is a plan view of the receptacle in the same embodiment.
Figure 7B:
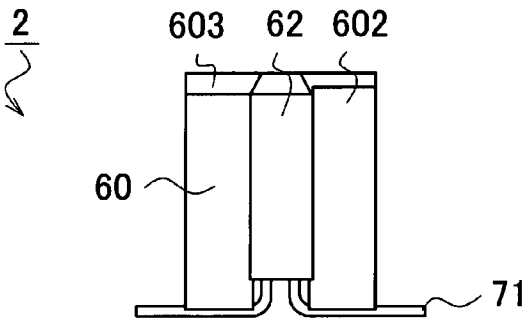
FIG. 7B is a side view of the same receptacle.

The receptacle 2 of FIG. 1 will now be described by using FIG. 6 and FIG. 7. FIG. 6 is a general perspective view taken from the above and showing the receptacle 2 of FIG. 1 with the fitting surface thereof directed upward. FIG. 7A is a plan view taken from the above and showing the receptacle 2 of FIG. 6 with the fitting surface thereof directed upward, and FIG. 7B is a side view of the receptacle 2 of FIG. 7A.

As shown in FIG. 6, the receptacle housing 60 forms a substantially rectangular solid having a pair of opposed flat walls 601, a pair of projection-carrying walls 602 provided so as to extend at right angles to the flat walls 601, and a bottom side wall 603 provided on the opposite side of the fitting surface and covering one of the openings surrounded by a frame formed by the flat walls 601 and the projection-carrying walls 602. The width "d"4 of the receptacle housing 60 is set smaller than the width "d"3 of the wall portion 11 of the plug 1 of FIG. 2. Accordingly, the receptacle 2 is held in the plug housing 10 of the plug 1.

The flat walls 601, the projection-carrying walls 602 and the bottom side wall 603 are all made of substantially rectangular and flat plates formed out of a resin. The projection-carrying walls 602 are provided with projections 62 extending outward in the direction in which the projections cross the fitting direction. The width "d"2 of the projection 62 is set smaller than the width "d"1 of the recess 12 provided in the wall portion 11 of the plug 1 of FIG. 2.

The receptacle housing 60 has a plurality of receptacle contacts 70 arranged in the longitudinal direction. The receptacle contacts 70 which are adjacent to each other in the longitudinal direction of the receptacle housing 60 are disposed in different positions in the lateral direction of the receptacle housing 60 as shown in FIG. 7A, and lie on a zigzag line in the longitudinal direction. This enables a large number of receptacle contacts 70 to be held in the small-sized receptacle housing 60.

Figure 8:
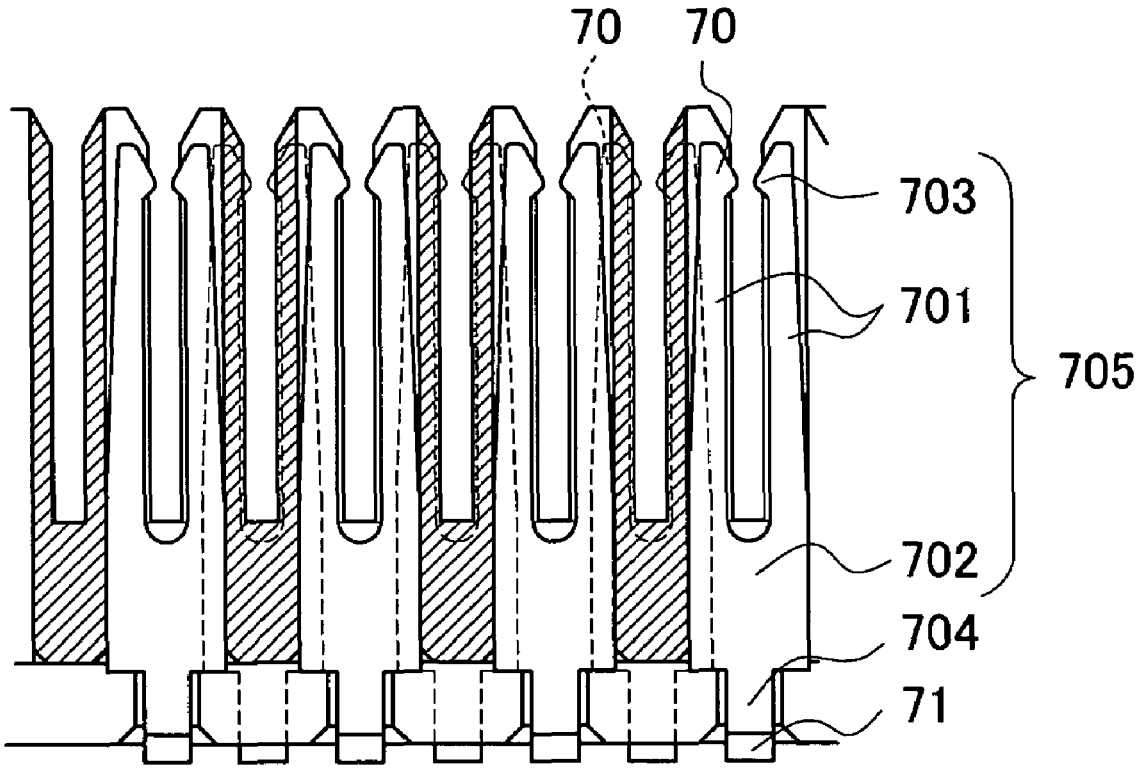
FIG. 8 is a sectioned schematic diagram showing a part of the receptacle in the same embodiment.

FIG. 8 is a schematic diagram showing a part of a sectional view of the receptacle 2 taken along the line Z—Z in FIG. 7A. FIG. 8 shows four receptacle contacts 70 shown by solid lines and three receptacle contacts 70 shown by broken lines. The receptacle contacts 70 shown by solid lines are arranged on the front side of the line Z—Z in FIG. 7A, and the receptacle contacts 70 shown by broken lines on the rear side of the line Z—Z.

The receptacle contacts 70 are formed by narrow metal pieces, each of which has a pair of claws 701, a base portion 702 and a receptacle leg portion 71. The claws 701 have swollen hook portions 703 at front edges thereof, and base ends of the claws 701 are joined together by the base portion 702, a holding portion 705 being thereby formed. A projecting portion 704 is joined to one side of the base portion 702 opposite to the side to which the claws 701 are joined. Thus, the receptacle contacts 70 as a whole form a tuning fork. The receptacle leg portion 71 is joined to the projecting portion 704.

The receptacle leg portion 71 extends in one lateral direction of the receptacle 2 as shown in FIG. 6 and projects from the receptacle housing 60. As shown in FIG. 7A, the receptacle leg portions 71 of the adjacent receptacle contacts 70 are extended so that each of the leg portions 71 extends toward the opposite in the lateral directions of the receptacle 2, i.e., forward and rearward alternately in FIG. 7A. These receptacle leg portions 71 are soldered to the board "k"2, and the receptacle 2 is thereby fixed to the board "k"2.

The engagement of the plug 1 and receptacle 2 with each other will now be described by using FIGS. 1, 9A to C, 10A to C and 11. As shown in FIG. 1, the plug 1 fixed to the board "k"1 and receptacle 2 fixed to the board "k"2 are disposed in positions in which the projections 62 provided on the outer side of the receptacle housing 60 are to be fitted into the recesses 12 of the wall portions 11 of the plug housing 10. When the projections 62 are then pressed in the fitting direction (vertical direction in FIG. 1), the projections 62 are moved down along the recesses 12. As a result, the receptacle 2 moves down along the inner side of the plug 1, and the receptacle 2 and the plug 1 are engaged with each other without causing strain to occur in the connector 5. The operation for carrying out the engagement of the plug 1 and the receptacle 2 with each other is executed by moving either one or both of the plug 1 and receptacle 2 in the fitting direction.

The receptacle housing 60 fitted into the plug housing 10 can be swung in the recesses 12 of the plug housing 10 in the direction crossing the fitting direction, which is namely the lateral direction of the recesses 12 (longitudinal direction in FIG. 1).

Figure 9C:
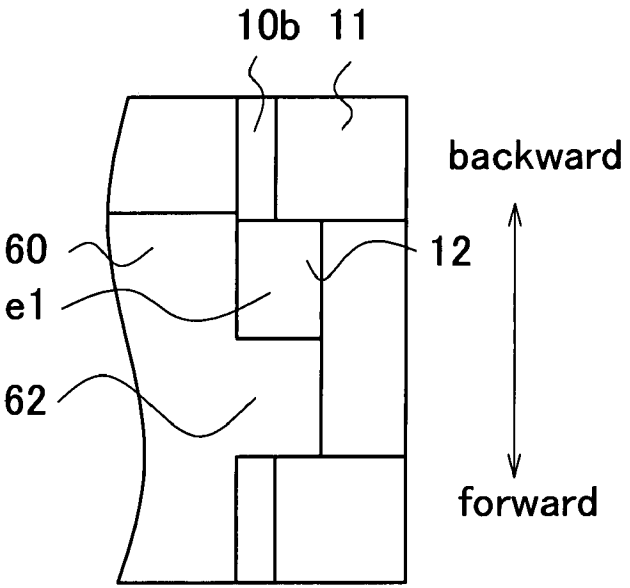
FIG. 9C is a drawing for describing the fitted condition of the second plug housing member and the receptacle housing in the same embodiment.
Figure 9B:
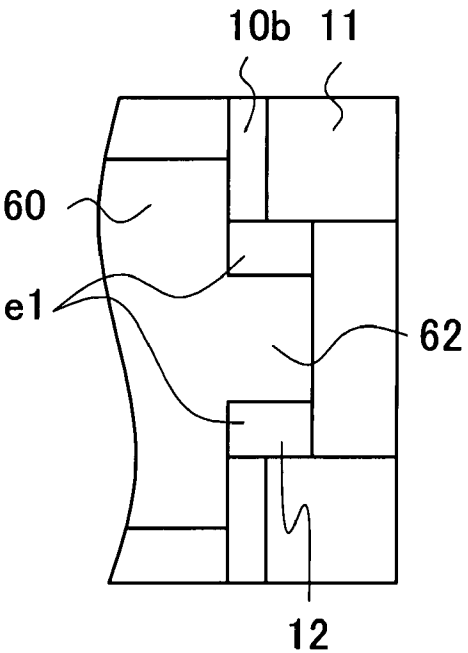
FIG. 9B is a drawing for describing the fitted condition of the second plug housing member and the receptacle housing in the same embodiment.
Figure 9A:
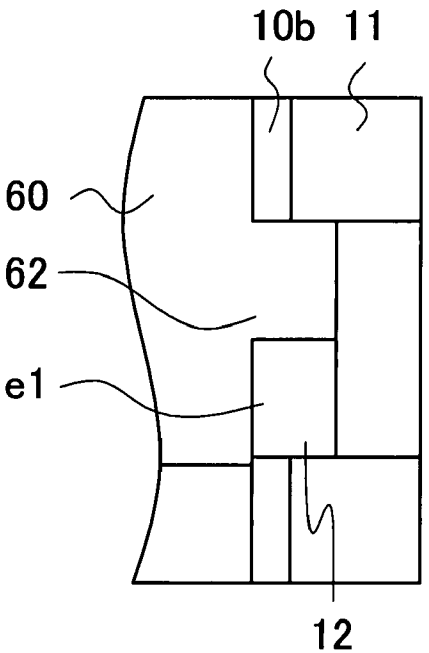
FIG. 9A is a drawing for describing the fitted condition of the second plug housing member and the receptacle housing in the same embodiment.

FIGS. 9A to C are schematic diagrams taken from the upper side of FIG. 1, showing the plug 1 of the same drawing, in which the second plug housing member 10*b* and the receptacle housing 60 have a clearance "e"1 and are in the swinging condition. Since the width "d"2 of the projecting portion 62 provided on the receptacle housing 60 is smaller than the width "d"1 of the recess 12 of the wall portion 11, the clearance "e"1, the width of which corresponds to a space between the width "d"1 and the width "d"3, occurs between the projecting portion 62 of the receptacle housing 60 and the recess 12 of the wall portion 11. Therefore, the receptacle housing 60 can be swung so that the receptacle housing 60 engaged with the plug housing 10 can be put in arbitrary condition, for example, the condition in which the receptacle housing 60 is one-sided in the rearward direction in the drawing as shown in FIG. 9A, the condition in which the receptacle housing 60 has clearances on longitudinally both sides of the projecting portion 62 as shown in FIG. 9B, and the condition in which the receptacle housing 60 is one-sided in the forward direction as shown in FIG. 9C. Since the plug 1 and the receptacle 2 are thus engaged swingably, the fitting of the plug 1 and the receptacle 2 is done easily. Moreover, a positional deviation occurring between the plug 1 and the receptacle 2 is absorbed.

As shown in FIG. 4, the recess 12 is provided with the tapering surface 120 at the front edge thereof, and a distance between a pair of wall portions 11 becomes longest at the front edge sections thereof. Therefore, when the receptacle 2 is fitted into the plug 1, it becomes easy to fit the projecting portion 62 provided on the receptacle housing 60 into the recess 12.

As shown in FIG. 5, the first plug housing member 10*a* and the second housing member 10*b* of the plug 1 are combined together in a mutually spaced manner. Accordingly, a positional deviation between the plug 1 and the receptacle 2 can be absorbed in the clearance between the first and second plug housing members 10*a*, 10*b*.

Figure 10C:
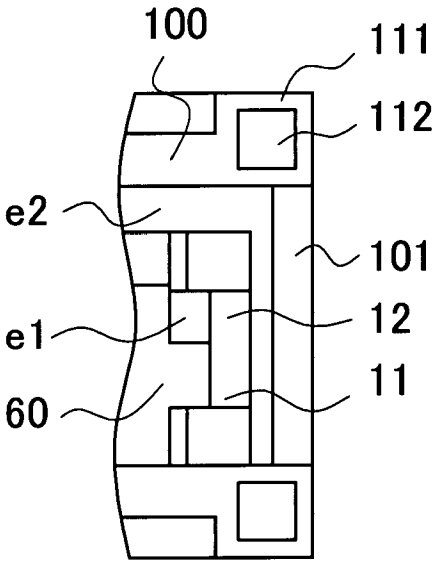
FIG. 10C is a drawing for describing the fitted condition of the first plug housing member and the second plug housing member in the same embodiment.
Figure 10B:
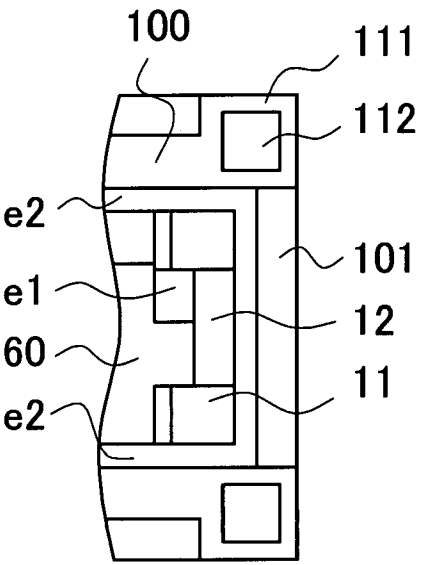
FIG. 10B is a drawing for describing the fitted condition of the first plug housing member and the second plug housing member in the same embodiment.
Figure 10A:
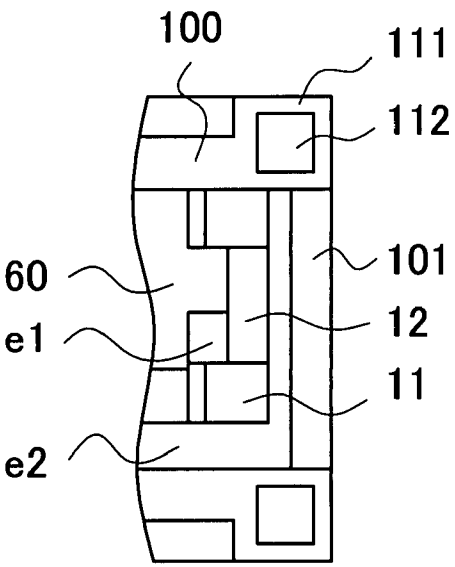
FIG. 10A is a drawing for describing the fitted condition of the first plug housing member and the second plug housing member in the same embodiment.

FIGS. 10A to C are schematic diagrams taken from the upper side of FIG. 1, showing the condition in which the second plug housing member 10*b* of the plug 1 of FIG. 1 swings in the clearance between the plug housing members 10*b*, 10*a*. When the space between the outer branching section 202*a* and inner branching section 202*b* of the connecting portion 202 is in a widened state as shown in FIG. 5, the second plug housing 10*b* has a clearance "e"2, the width of which corresponds to the distance between the outer and inner branching sections 202*a*, 202*b*, on longitudinally both side parts of the second plug housing member 10*b* as shown in FIG. 10B. On the other hand, when the space between the outer branching section 202*a* and the inner branching section 202*b* is narrowed and brought into contact with each other, the clearance "e"2 occurs in a one-sided state at either one of the longitudinal sides of the second plug housing member 10*b* as shown in FIG. 10A or FIG. 10C. Thus, a positional deviation is absorbed in the clearance "e"1, and in the clearance "e"2 as well. The plug 1 is formed to a two-stage positional deviation absorption structure.

Figure 11:
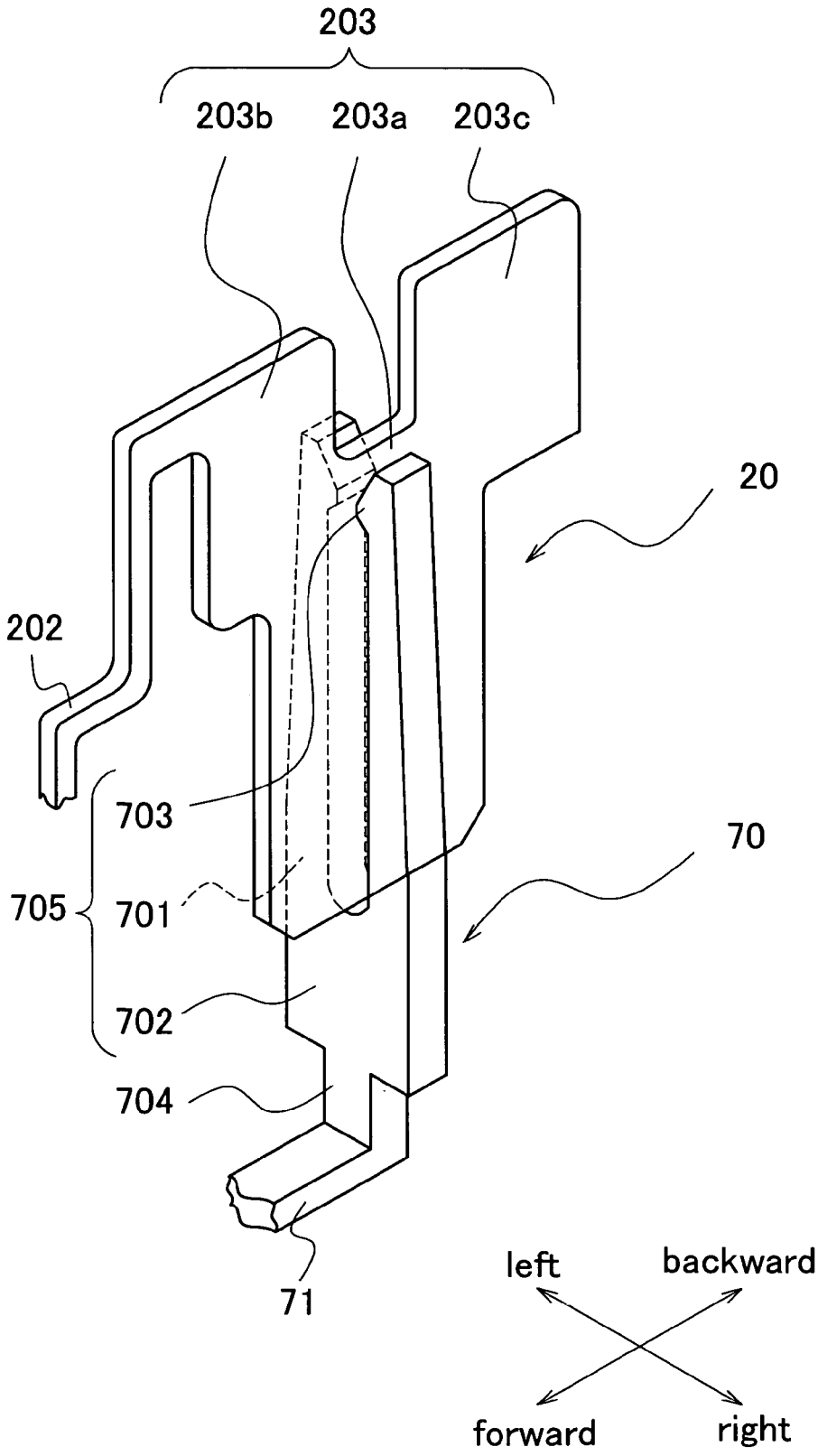
FIG. 11 is a drawing for describing the connected condition of a plug contact and a receptacle contact in the same embodiment.

The condition connected the plug contacts 20 and the receptacle contacts 70 of FIG. 1 will now be described by using FIG. 11. FIG. 11 is a schematic diagram showing the plug contact 20 and the receptacle contact 70 in a connected state. The plate type section 203*a* of the contact portion 203 of the plug contact 20 is held in the holding portion 705 of the receptacle contact 70, so that the plug contact 20 and the receptacle contact 70 are connected together. The plug contact 20 and the receptacle contact 70 are all formed out of a conductive material, such as a metal, and has elasticity. Accordingly, the plug contact 20 and the receptacle contact 70 can be swung in a mutually engaged state in two directions (longitudinal direction and lateral direction in FIG. 11) which cross the fitting direction between the plug 1 and the receptacle 2, and a positional deviation occurring between the plug 1 and the receptacle 2 is absorbed.

Since the receptacle contact 70 holds the plate type section 203*a* of the plug contact 20 between the two claws 701, the connection between the receptacle contact 70 and plug contact 20 is made more reliably. Moreover, the hook portions 703 provided at the front edge of the claw 701 also further ensure the connection between the plug contact 20 and the receptacle contact 70. Namely, even when one or both of the receptacle contact 70 and the plug contact 20 are swung in the direction crossing the fitting direction and also crossing the direction (longitudinal direction in FIG. 11) in which the receptacle contact 70 and plug contact 20 are arranged, a failure in the connection between the plug contact 20 and the receptacle contact 70 can be prevented.

The present invention can be used to electrically connect boards on which electric circuits are implemented. More concretely speaking, the connector according to the present invention absorbs a deviation which occurs in the connector when a pair of boards on which the connector is mounted is moved, and connects the boards together.

What is claimed is:

1. A connector comprising:

a plug, the plug having:

a plurality of plug contacts, each plug contact having a plate contact portion; and a plug housing for holding the plug contacts, the plug housing having a wall portion and a recess; and a receptacle, the receptacle having:

a plurality of receptacle contacts, each receptacle contact having a bifurcated holding portion; and a receptacle housing for holding the receptacle contacts, the receptacle housing having a projecting portion;

wherein the plug contacts and the receptacle contacts correspond so as to be engageable and form electrical connections when the plug is inserted into the receptacle;

wherein the projecting portion of the receptacle housing protrudes outward and extends parallel to a direction of insertion of the plug into the receptacle;

wherein the wall portion of the plug housing extends in the direction of insertion of the plug into the receptacle;

wherein the recess of the plug housing is engageable with which the projecting portion of the receptacle housing;

wherein the width of the projecting portion of the receptacle housing is smaller than the width of the recess of the plug housing; and wherein the bifurcated holding portion is substantially orthogonal to the contact portion so as to grasp the surfaces of the contact portion, the plug housing further comprising:

a first plug housing member and a second plug housing member; and each of the plug contacts further comprising:

a plug leg portion and a connecting portion;

wherein the second plug housing member is disposed inside of the first plug housing member away from the first plug housing member, and the second plug housing member has the wall portion and the recess;

wherein a part of the contact portion of the plug contact is embedded in the second plug housing member;

wherein a part of the plug leg portion of the plug contact is embedded in the first plug housing member; and wherein the connecting portion connects the contact portion and the plug leg portion for connecting the first plug housing member and the second plug housing member.

2. A connector comprising:

a plug, the plug having:

a plurality of plug contacts, each plug contact having a plate contact portion; and a plug housing for holding the plug contacts, the plug housing having a wall portion and a recess; and a receptacle, the receptacle having:

a plurality of receptacle contacts, each receptacle contact having a bifurcated holding portion; and a receptacle housing for holding the receptacle contacts, the receptacle housing having a projecting portion;

wherein the plug contacts and the receptacle contacts correspond so as to be engageable and form electrical connections when the plug is inserted into the receptacle;

wherein the projecting portion of the receptacle housing protrudes outward and extends parallel to a direction of insertion of the plug into the receptacle;

wherein the wall portion of the plug housing extends in the direction of insertion of the plug into the receptacle;

wherein the recess of the plug housing is engageable with which the projecting portion of the receptacle housing;

wherein the width of the projecting portion of the receptacle housing is smaller than the width of the recess of the plug housing;

wherein the bifurcated holding portion is substantially orthogonal to the contact portion so as to grasp the surfaces of the contact portion;

wherein the recess extends to a front edge of the wall portion; and wherein the death of the recess increasing toward the front edge of the wall portion, the plug housing further comprising:

a first plug housing member and a second plug housing member; and each of the plug contacts further comprising:

a plug leg portion and a connecting portion;

wherein the second plug housing member is disposed inside of the first plug housing member away from the first plug housing member, and the second plug housing member has the wall portion and the recess;

wherein a part of the contact portion of the plug contact is embedded in the second plug housing member;

wherein a part of the plug leg portion of the plug contact is embedded in the first plug housing member; and wherein the connecting portion connects the contact portion and the plug leg portion for connecting the first plug housing member and the second plug housing member.

* * * * *